United States Patent [19]

Weldon

[11] 4,155,178

[45] May 22, 1979

[54] TUBE FOR IMPINGING JET AIR DRIER

[75] Inventor: French O. Weldon, Jacksonville, Fla.

[73] Assignee: U.S. Natural Resources, Inc., Portland, Oreg.

[21] Appl. No.: 862,219

[22] Filed: Dec. 19, 1977

[51] Int. Cl.[2] ..... F26B 13/04

[52] U.S. Cl. ..... 34/155; 34/156; 34/224; 239/557

[58] Field of Search ..... 34/155, 156, 160, 230, 34/232, 223, 224; 239/556, 557, 553.3, 553.5; 226/97; 432/96

[56] References Cited

U.S. PATENT DOCUMENTS

| | | | |
|---|---|---|---|
| 1,607,220 | 11/1926 | Von Ehrenthal et al. | 34/156 |
| 3,127,080 | 3/1964 | Allander et al. | 34/156 |
| 3,763,571 | 10/1973 | Vits | 226/97 |
| 3,968,936 | 7/1976 | Brühlmeier | 239/557 |

*Primary Examiner*—John J. Camby

*Assistant Examiner*—Larry I. Schwartz

[57] ABSTRACT

A tube for an impinging jet air drier for wood veneer has a circular cross-section throughout 270 degrees of its circumference, the remaining 90 degrees comprising two planar portions, one disposed perpendicularly to the direction of travel of a sheet of material through the drier, the other generally facing the sheet of material but forming an obtuse angle with the first portion at a line of juncture disposed in the downstream direction of sheet travel. A plurality of round holes are punched in the planar portion facing the sheet of material. The holes are disposed in rows parallel to the longitudinal axis of the tube. The shape of the tube serves as a guide for the sheet material while discharging air thereacross. The configuration permits the upper tube in each pair to be disposed about $\frac{5}{8}$ inch above the plane of travel of the sheet material and the lower tube to be disposed about $\frac{3}{8}$ inch therebelow.

8 Claims, 7 Drawing Figures

FIG. 1
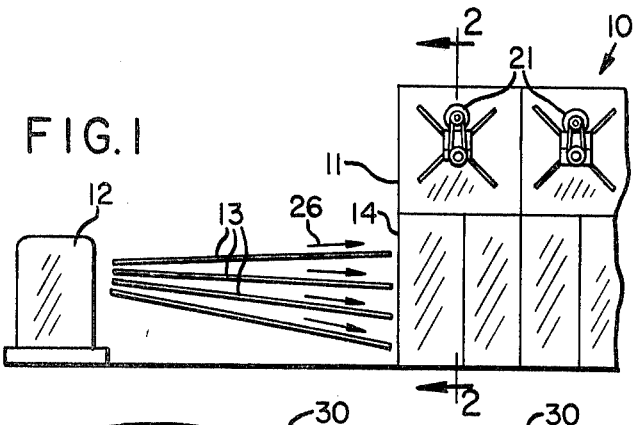
FIG. 2
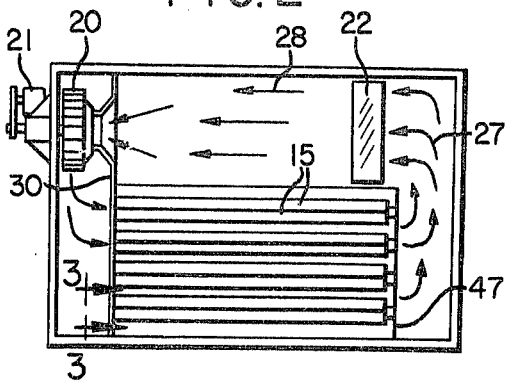
FIG. 3
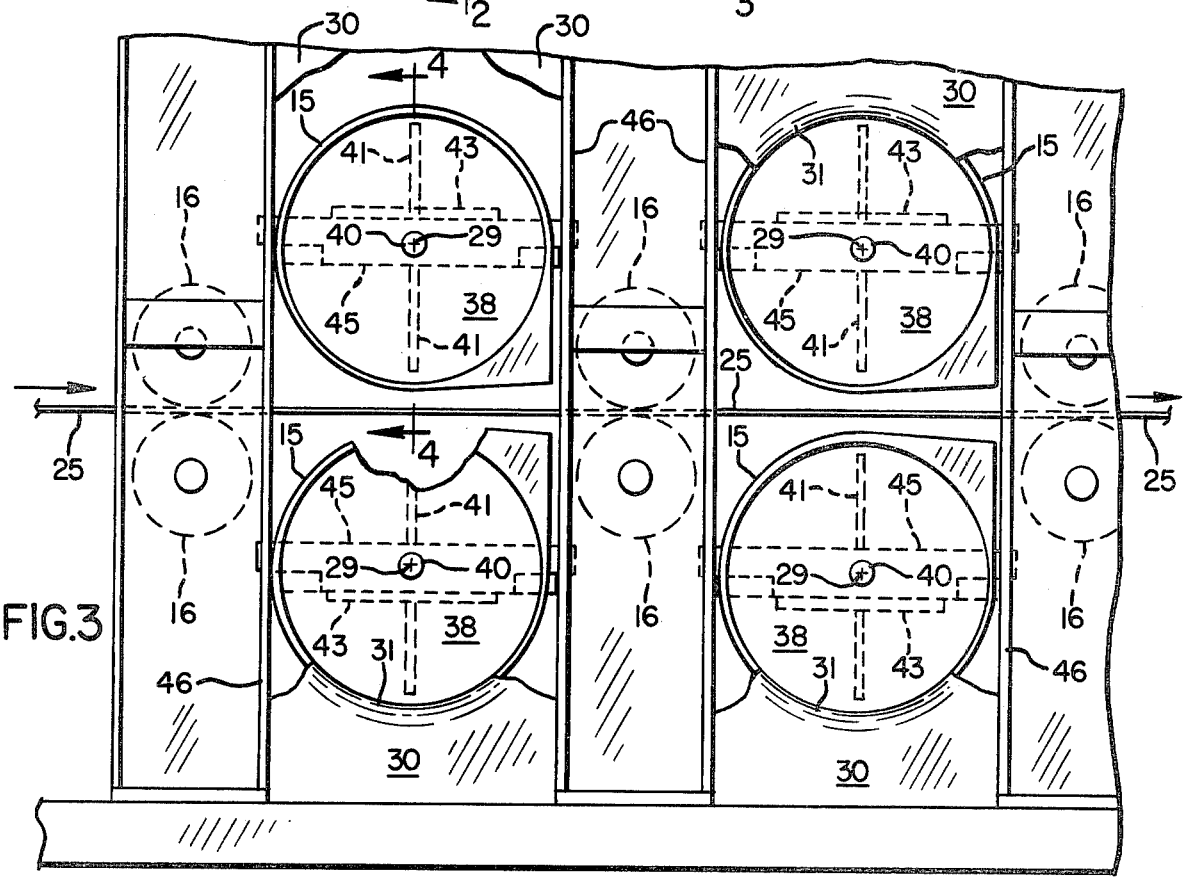
FIG. 4
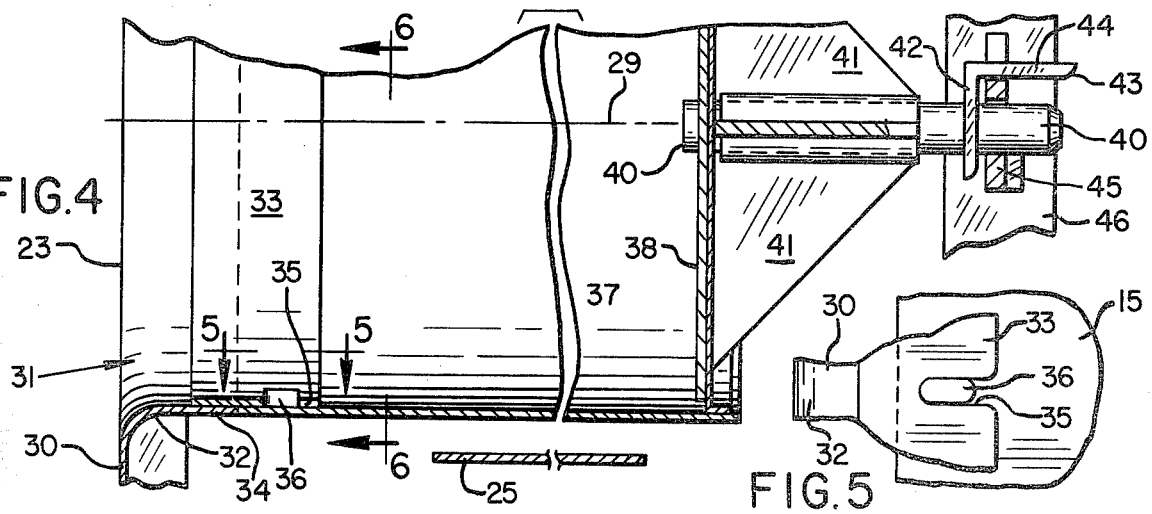
FIG. 5

TUBE FOR IMPINGING JET AIR DRIER

BACKGROUND OF THE INVENTION

This invention relates to impinging jet air driers for use in the drying of large sheet material, such as strips or sheets of veneer and, more particularly, to the configuration of the jet drier tubes which serve to impinge heated air onto the sheet material as the same travels through the drier.

The design of jet drier tubes used in impinging jet air driers has posed a difficult problem for a long time. A variety of configurations have been tried, but none has been completely satisfactory. Among critical factors involved in the design are the cross-sectional shape of the tube itself, the size, shape and distribution of the jet orifices or apertures, and the spacing or distance of the tubes above and below the plane of travel of the sheet material as it passes through the drier.

A variety of cross-sectional configurations have been tried. Morris U.S. Pat. No. 3,418,727 and Holden et al. U.S. Pat. No. 3,474,544 disclose tubes with square cross-sections, but since the longitudinal axes of the tubes are disposed perpendicular to the direction of travel of the wet or "green" veneer as it passes through the drier, the upstream corner of a square tube tends to cause the often curled leading edge of the veneer strip to hang-up as it passes by, thereby causing a jam and the operation to be stopped. To obviate the problem, it has been necessary to space the tubes or boxes an undesirably large distance away from the sheet material, thereby to lose drier efficiency. Morris U.S. Pat. No. 3,314,164 discloses an attempt to remedy this deficiency by providing a trapezoidal cross-section, with the upstream edge of the box spaced further away from the sheet material. This configuration, however, sacrifices the ability of the drier box to function as a veneer guide on the upstream side thereof.

Stock U.S. Pat. No. 3,324,571 disloses jet tubes of circular cross-section. While this configuration avoids any hang-up problem on the upstream side, it fails to provide any guiding function on the downstream side, thereby to allow the sheet veneer to curl up between the tube and the next pair of drive rolls, thereby also to cause work stoppages.

The configuration of the actual orifice itself has also posed a problem. Morris U.S. Pat. No. 3,314,164 and Stock U.S. Pat. No. 3,324,571 disclose drier tubes having recessed orifices comprising elongated slots with inwardly extending flanges. Recessing the orifice, however, often causes the sheet veneer to get caught up in the discharge slot, also to cause a plug-up and work stoppage.

The use of multiple apertures has been disclosed as a way of improving drying efficiency. In "Plywood Manufacturing Practices," by Richard F. Baldwin, published 1975 by Miller Freeman Publications, Inc., San Francisco, Calif., page 153, it is stated that three rows of strategically located openings on the face of a jet tube more efficiently scrub the veneer and transfer the heat than do conventional one-row openings. Comstock U.S. Pat. No. 3,739,490 discloses such a plurality of orifices spaced in a particular pattern on the box face, but the tube or box configuration is rectangular in cross-section, tapering longitudinally, and does not avoid the hang-up problems at the upstream edge as above discussed.

It is thus the primary object of the present invention to provide an improved configuration for a jet drier tube or box, such that the tube is shaped and can be spaced sufficiently close to the sheet material to serve as a guide on both the upstream and downstream sides thereof.

It is a further object of the present invention to provide such a tube or box with an orifice or aperture pattern that will provide improved and efficient transfer of heat to the veneer.

It is a still further object of the present invention to provide such a tube with orifices or apertures of a type that will obviate the possibility of the sheet material plugging up the orifices when the tubes are positioned very close to the traveling sheet material.

It is a still further object of the present invention to provide a jet drier tube that will have clean, smooth lines throughout the zone where the veneer passes through, and that can discharge an increased volume of air over a wider area of the veneer than has been heretofore possible.

SUMMARY OF THE INVENTION

The jet drier tube of the present invention is substantially constant in cross-section along the length thereof and has a closed end and an open end in communication with a source of heated air under positive static pressure. The tubes of the present invention are generally arranged in pairs, one tube of each pair being disposed above the plane of travel of a sheet of material to be dried and the other tube being disposed therebelow. The longitudinal axes of the tubes are disposed perpendicular to the direction of travel of the sheet material through the drier, as is typical in driers of this type.

The tube of the present invention has a circular cross-section throughout a portion comprising about 270 degrees of its circumference, the remaining 90 degrees of its circumference comprising two planar portions. One of these two planar portions is disposed perpendicular to the direction of travel of the sheet of material to be dried. The other of the two planar portions is disposed generally facing the sheet of material, but forms a slightly obtuse angle with the first, or perpendicular planar portion at a line of juncture disposed in the downstream direction of travel of the sheet. In this manner, such other or facing planar portion diverges slightly from the sheet of material in the downstream direction of travel thereof.

The tubes of the invention are typically disposed in the driers such that the tube above the sheet is positioned a greater distance away from the sheet than is the tube disposed therebelow.

A plurality of spaced apertures are disposed in the planar portion generally facing the sheet material. The apertures are disposed entirely in the plane of the facing portion without any recessed slots or flanges. The apertures are disposed in a plurality of rows extending parallel to the longitudinal axis of the tube, whereby heated air discharged through the apertures impinges on the sheet material over a zone extending transversely thereacross.

Preferably, the apertures comprise round holes punched in the planar portion of the tube generally facing the sheet material. Preferably, the apertures are disposed in rows parallel to the longitudinal axis of the tube, with the spacing of the holes being uniform in the longitudinal direction and with individual holes in each row being staggered with respect to their counterparts in adjacent rows for uniformity of air distribution across the sheet surfaces.

The tubes may be disposed closer to the traveling sheet material than has been heretofore possible. I have found that with my new configuration it is possible to position the upper tube as close as $\frac{5}{8}$ inch above the sheet material passing therebelow, and the lower tube as close as $\frac{3}{8}$ inch below the sheet material.

BRIEF DESCRIPTION OF THE DRAWINGS

FIG. 1 is an elevational view of the in-feed or "wet" end of a sheet veneer drier of a type particularly adapted for use with jet tubes of the present invention.

FIG. 2 is a cross-sectional view taken on line 2—2 of FIG. 1.

FIG. 3 is a sectional view to an enlarged scale taken on line 3—3 of FIG. 2.

FIG. 4 is a foreshortened partial sectional view taken on line 4—4 of FIG. 3 to an enlarged scale.

FIG. 5 is a sectional view taken on line 5—5 of FIG. 4.

DESCRIPTION OF THE PREFERRED EMBODIMENT

Figure 6:
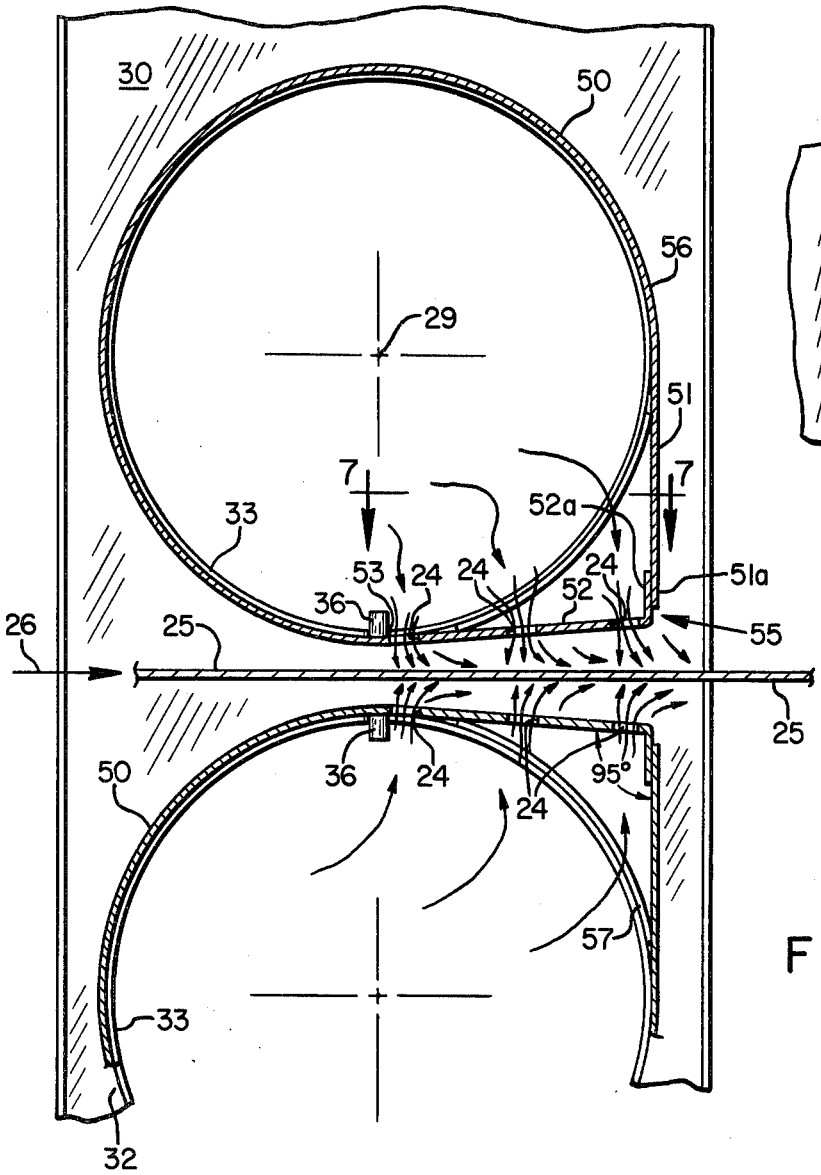
FIG. 6 is a sectional view taken on line 6—6 of FIG. 4.

A drier 10 suitable for use with the invention is illustrated in FIGS. 1 and 2. It has a green or "wet" end zone 11 to which an automatic feeding machine 12 feeds wet veneer sheets on infeed conveyor guides 13 through suitable openings in the end wall 14. The sheets travel along horizontal paths through the drier between jet tubes 15, being propelled by drive rolls 16. A plurality of fans 20 belt driven by motors 21 mounted exteriorly of the drier 10 are adapted to circulate air heated by a steam heating unit 22 through the open ends 23 of the tubes 15 for egress through tube orifices or apertures 24 and impingement on the veneer sheets 25. See FIGS. 3-6. The direction of travel of the sheets 25 is indicated by the arrows 26 in FIGS. 1, 3 and 6. The direction of air flow, which is crosswise of the direction of travel of the sheets, is indicated by the arrows 27, 28 in FIG. 2.

The tubes 15 are arranged in pairs above and below the paths of travel of the veneer sheets 25. The tubes 15 are placed intermediate the pairs of drive rolls 16, as is customary in driers of this type, such that the longitudinal axes 29 of the tubes are perpendicular to the direction of travel of the sheets 25 as they pass through the drier. The tubes 15 are supported at their air-ingress or open ends 23 by vertically disposed plates 30 having openings 31 provided with collars 32 extending inwardly of the drier, as shown in FIG. 4. A reinforcing sleeve 33 is attached to the inner end 34 of each of the collars 32. The sleeve 33 fits interiorly of the open end 23 of each tube 15, thereby to support the same as shown. Each of the reinforcing sleeves 33 is provided with a keyway 35 to receive an alignment boss or key 36 welded to the tube 15 for proper orientation of the tube.

The opposite end 37 of each tube 15 is closed by a plate 38 so that air entering the open end 23 is discharged only through the apertures 24. A rod 40 is attached to each of the plates 38 centrally thereof and is stiffened by gusset plates 41, as shown in FIG. 4. Each rod 40 is received in an opening in the vertical leg 42 of an angle 43, the horizontal leg 44 of which is supported on a retainer bar 45 supported by column members 46 positioned at the side 47 of the drier opposite the fans 20.

The jet tubes 15 are substantially constant in cross-section along the lengths thereof. As shown in detail in FIG. 6, each tube 15 is preferably made of 20 gauge heat resistant sheet material formed so that it has a circular cross-section throughout a portion 50 comprising about 270 degrees of its circumference. The remaining 90 degrees of its circumference is formed with two planar portions 51, 52, portion 51 being disposed perpendicularly to the plane of travel of the veneer sheets 25 as they pass through the drier. The portion 52 extends downstream from a line of tangency 53 with the circular portion 50 and is positioned generally to face the veneer sheet material, as shown. The edge **52*a* of the portion 52 is bent for attachment, as by spot welding, to the edge 51*a* of the portion 51**.

The portion 52 of each tube 15 is not disposed parallel to the plane of travel of the veneer sheets 25, but is disposed to form an angle of about 95 degrees with the portion 51, the two surfaces meeting at a theoretical line of juncture 55 which is disposed in the downstream direction of travel of the veneer sheets. An arcuate stiffener plate 57 is positioned at the end of each tube 15 to stiffen the same where the portions 51 and 52 are joined.

It is to be noted that the portion 52 is positioned such that its line of tangency 53 with the circular portion 50 lies generally in the plane defined by the longitudinal axes 29 of each pair of tubes, the line of tangency 53 thereby being the closest element of the tube 15 to the plane of travel of the veneer sheets 25. In this manner, the circular portion 50 of each tube serves as a guide for the veneer sheet as the same enters the region between a pair of tubes 15, and the portion 52 serves as a guide for the veneer sheet as it leaves the region between the tubes 15. There is thus no sharp corner on the upstream side of the tube to cause a hang-up, yet the veneer sheets are fully guided as they travel between the tubes.

Where a jet tube is typically made about 15 feet long, the circular portion 50 thereof is preferably formed with an outer diameter of $7\frac{1}{2}$ inches. The distance from the line of tangency 56 of the portion 51 with the circular portion 50 to the theoretical line of juncture 55 is preferably made $3\frac{1}{2}$ inches. The portion 52 is formed with a slope of about $\frac{1}{4}$ inch in the distance between its line of tangency 53 with the circular portion 50 and the theoretical line of juncture 55, whereby the portion 52 diverges or slopes away from the plane of travel of the veneer sheet material in the downstream direction thereof by this amount.

Figure 7:
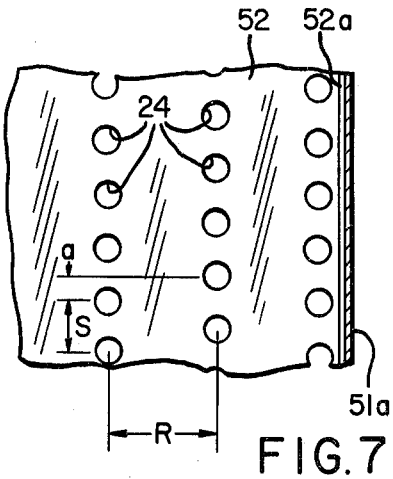
FIG. 7 is a sectional view taken on line 7—7 of FIG. 6.

The size, shape and distribution of the jet apertures 24 are also a feature of the present invention. I have found that exceedingly good results are obtained when the apertures 24 comprise 5/16 inch diameter round holes punched in the planar portion 52 on one inch centers in three rows spaced $1\frac{1}{2}$ inches apart in the direction of travel of the veneer sheets 25. The individual apertures 24 are preferably staggered or offset 11/32 inch as respects their counterparts in adjacent rows, the three rows being generally symmetrically disposed in the planar portion 52. It is thus noted that all apertures 24 lie downstream of the line of tangency or juncture 53 of the planar portion 52 with the circular portion 50, that is, all apertures 24 are positioned downstream of the plane defined by the longitudinal axes 29 of each pair of tubes 15. As illustrated in FIG. 7, the distance between the rows, R, is preferably 1½ inches; the spacing of the apertures 24, S, is preferably one inch; and the stagger or offset, a, of each aperture 24 as respects its counterpart in an adjacent row is preferably 11/32 inch.

I have found that the use of round holes punched in the planar portions 52 of the tubes 15 eliminates any plug-ups that have been caused in the past when tubes have been provided with recessed orifices comprising elongated slots with inwardly-extending flanges. The three rows of round holes spaced to cover a three inch area across the veneer, provide the same with a more uniform air flow and larger volume of air than has been possible heretofore. The spacing of the holes gives full air coverage across the veneer, which is very advantageous for efficient drying.

Surprisingly, I have found that it is possible to position the jet tubes much closer to the plane of travel of the veneer sheets than has heretofore been possible. The upper tubes may be positioned as close as ⅝ inch above the sheet material, and the lower tubes may be positioned as close as ⅜ inch therebelow. The close positioning of the tubes results in greater efficiency in heat transfer than has been possible heretofore.

The tube also eliminates plug-ups because its novel configuration provides clean, smooth guide lines where the veneer passes through. Production has been found to be materially increased because of the spacing of the holes and the increased volume of air which can be discharged over a wider area of the veneer. Guidance is also provided for the veneer sheet at both the upstream and downstream sides of the tubes.

While a detailed example of a preferred embodiment of the invention has been described, it is to be understood that changes and modifications may be made without departing from the spirit of the invention. All such changes and modifications are intended to be included within the scope of the following claims.

I claim:

1. In an impinging jet air drier for sheet material:

a plurality of opposed jet drier tubes, said tubes being substantially constant in cross-section along the length thereof, each of said tubes having a closed end and an open end in communication with a source of heated air under positive static pressure, said tubes being arranged in pairs, one tube of each pair being disposed above a sheet of material to be dried, the other tube of each pair being disposed below said sheet of material to be dried, the longitudinal axes of said tubes being perpendicular to the direction of travel of said sheet through said drier, each of said tubes having a circular cross-section throughout a portion comprising about 270 degrees of its circumference, the remaining 90 degrees of its circumference comprising two planar portions, said planar portions meeting at a line of juncture disposed in the downstream of travel of said sheet of material, one of said two planar portions being disposed perpendicularly to said direction of travel of said sheet of material to be dried, the other of said two planar portions generally facing said sheet of material to be dried, but forming an obtuse angle with said one planar portion at said line of juncture, whereby said other of said two planar portions diverges from said sheet of material in the downstream direction of travel thereof, said one tube of each pair being disposed above said sheet of material a distance greater than said other tube is disposed below said sheet of material; and a plurality of spaced apertures disposed in each of said other of said planar portions of said tubes, said apertures being disposed entirely in the plane of said portions, said apertures being disposed in a plurality of rows, said rows extending generally parallel to said longitudinal axes of said tubes, said heated air being discharged through said apertures to impinge on said sheet of material over a zone extending transversely thereacross.

2. An impinging jet air drier as in claim 1, in which the line of tangency of said other of said two planar portions with said circular portion of each of said tubes lies generally in the plane defined by the longitudinal axes of each of said pairs of tubes, said other of said two planar portions being disposed downstream of said plane.

3. An impinging jet air drier as in claim 2, in which said apertures are disposed in rows parallel to the longitudinal axis of each of said tubes, said rows being symmetrically disposed in said other of said planar portions.

4. An impinging jet air drier as in claim 1, in which said apertures comprise round holes punched in said other of said planar portions.

5. An impinging jet air drier as in claim 1, in which said one tube of each pair is disposed about ⅝ inch above said sheet of material and said other tube of each pair is disposed about ⅜ inch therebelow.

6. A jet drier tube for an impinging jet air drier utilizing a plurality of said tubes for drying sheet material, said tube having an open air-inlet end and a closed opposite end, said tube being of substantially constant cross-sectional dimension and shape along the major portion of its length, said tube having sheet material-confronting surface portions, including a leading surface portion and a trailing surface portion as determined by the direction of sheet material travel past said tube, said leading surface portion having an arcuate cross-section through at least about a 90 degree segment of the tube circumference from a juncture with said trailing surface portion, said trailing surface portion being planar and extending rearwardly in the direction of sheet travel in an approximate line of tangency from said juncture, said planar trailing surface portion including a plurality of spaced apertures disposed throughout the sheet material-confronting length of said tube and also disposed across the width of said trailing surface portion, said apertures being disposed in the plane of said trailing surface portion.

7. A jet drier tube according to claim 6 wherein said tube has a circular cross-section throughout about 270 degrees of its circumference, including said leading surface portion, the remaining degrees of its circumference, including planar surface portions.

8. A jet drier tube according to claim 6 wherein said tube has at least two planar surface portions including said trailing surface portion, said trailing surface portion terminating at its trailing end at a juncture with a second planar surface portion, said trailing and second trailing surface portions meeting at approximately a right angle.

* * * * *